US006279159B1

(12) United States Patent
Ahlbäumer et al.

(10) Patent No.: US 6,279,159 B1
(45) Date of Patent: Aug. 28, 2001

(54) PROTECTION AID FOR PROTECTING THE HANDS AND WRISTS OF SKETERS

(75) Inventors: Georg Ahlbäumer, Chesa Sansano, CH-7522 La Punt (CH); Valter Micheloni; Fabrizio Giugni, both of Albosaggia (IT)

(73) Assignee: Georg Ahlbäumer, St. Moritz (CH)

( * ) Notice: Subject to any disclaimer, the term of this patent is extended or adjusted under 35 U.S.C. 154(b) by 0 days.

(21) Appl. No.: 09/131,233

(22) Filed: Aug. 7, 1998

(51) Int. Cl.[7] ..... A41D 13/00

(52) U.S. Cl. ..... 2/20; 2/16

(58) Field of Search ..... 2/16, 20, 161.1; 602/21, 64

(56) References Cited

U.S. PATENT DOCUMENTS 5,279,545 * 1/1994 Reese, Sr. ..... 602/21
5,487,188 * 1/1996 Micheloni et al. ..... 2/16

* cited by examiner

*Primary Examiner*—Bibhu Mohanty
(74) *Attorney, Agent, or Firm*—Rosenman & Colin LLP

(57) ABSTRACT

The present invention relates to a protective aid for protecting the hands and wrists of skaters, which comprises a first protective element to be arranged on that region of the hand palm situated near the wrist. The protective aid comprises moreover a second protective element which can be arranged on the inside portion of the wrist and which is connected to the first protective plate via a connecting element. The protective aid is provided with engagement means for engaging the hand and/or wrist of the user, in order to firmly connect the protective aid to the user's hand, during use.

171 Claims, 5 Drawing Sheets

PROTECTION AID FOR PROTECTING THE HANDS AND WRISTS OF SKETERS

BACKGROUND OF THE INVENTION

The present invention relates to a protective aid for protecting the hands and wrists of skaters.

As is known, a lot of persons, in particular young people, practise skating sprots, both at an agonistic level and at a hobby level, mainly due to the fact that are easily available on the market new types of skates comprising four aligned skating wheels.

In particular, these new types of skates allow the skater to easily control his/her skate while greatly facilitating directional changes.

On the other hand, the learning of a proper use of these skates is very difficult and requires a great perseverance by an inexperienced skater.

Moreover, in practicing this sport, particularly at the start thereof, the skater is frequently subjected to dangerous failings because of a frequently occurring equilibrium loss.

During these falls, the skater tends instinctively to limit possible damages by abutting against ground that portion of his/er hand palm arranged near the wrist, both in a case of a frontwardly fall and in the case of a backwardly fall.

Thus, the region of the hand palm adjoining the wrist is inevitably subjected to a traumatic reaction which, in many cases is very painful and requires several days for recovering and, frequently, a proper orthopedic care.

In this connection, it should be pointed out that the impact against the hand palm can also damage the articulation of the user's wrist, in particular because of an excessive extension movement (hyperextension) of the hand with respect to the forearm, which can lead to a radius extension fracture, which is a classical injury pattern of a fall on the outstretched forearm (compare in this respect the article by G. Ahlbäumer et al. "Injury Pattern and Prevention of Wrist Injuries in Snowboarding",Proceedings of the ECOSA 6th International Conference on Product Safety Research, Amsterdam 1998, published on Jun. 15, 1998).

Moreover, the hand palm and wrist constitute the regions more exposed to impact dangers even as the user encounters along the skating path obstacles which the user tends to avoid by using his/her hand.

PRIOR ART

From U.S. Pat. No. 5,487,188 a glove for protecting the ligaments, articulations and bones of the hand is known comprising a glove body with a plate for protecting the hand palm and tie-straps connecting the fingers of the glove body with the plate. Further, a shield to be located on the inner side of the forearm is articulated to the plate. The protective device as disclosed in the U.S. Pat. No. 5,487,188 prevents that in the case of a violent impact against ground the fingers are bent beyond a natural allowable bending angle. Dangers associated with a hyperextension of the hand with respect to the forearm in the course of a fall on the ground are not considered in the U.S. patent and the protective device is not capable of protecting against such hyperextension movements, since the shield is basically freely movable with respect to the glove body and the forearm, so that basically a free extension movement of the hand with respect to the forearm without any limitation or slowing down is possible.

Further, wristguards are known having a glove-like or cuff-like (sleeve-like) textile part to which at least one stiff splint in the form of a plastic insert is fixed or fixable. By means of the splint the hand is more or less fixed in a given position with respect to the forearm so that extension movements of the hand with respect to the forearm are prevented altogether. Due to the stiffness of the splint, pressure points on the forearm can be created at the splint top in case of a fall which may cause forearm fractures. Further, the muscles relevant to the extension movements are immobilized or even paralyzed so that natural reflexes which could help to prevent injuries are slowed down or at worst are suppressed altogether.

SUMMARY OF THE INVENTION

It is an object of the present invention to provide a protective aid for protecting a hand and wrist of a skater, which allows a very good protection of those regions of the hand palm and wrist susceptible to be exposed to traumatic impacts in case of a fall.

Further it is an object of the present invention to provide such a protective aid which allows a very good protection against injuries, which can be caused by excessive extension movements of the hand with respect to the forearm.

Another object of the present invention is to provide such a protective aid which can be fitted to a user hand in a very simple and quick manner.

Yet another object of the present invention is to provide such a protective aid which can be made from easily available materials and at a comparatively low cost.

According to one aspect of the invention, at least one of the above objects, as well as of yet other objects, which will become more apparent hereinafter, is achieved by a protective aid for protecting a hand and wrist of a skater, characterized in that said protective aid comprises a first protective element, which can be arranged on that region of the hand palm near the wrist, and a second protective element, which can be arranged on the inside portion of the wrist, and being connected with the first protective element via a connecting element, said protective aid being provided with engagement means for engaging for engaging at least one of a hand and a wrist of the skater.

According to a preferred embodiment, said first protective element comprises a first protective plate and said second protective element comprises a second protective plate, said protective plates preferably being shaped shell-like.

For providing for an effective engagement between protective aid and hand and wrist it is suggested said engagement means comprises first engagement means associated with the first protective element for engaging a hand of the skater and comprising second engagement means associated with the second protective element for engaging a wrist of the skater. Said first engagement means can comprise at a side region of the first protective element a ring-like portion for receiving a hand thumb in a ring hole which preferably has self-centering properties to provide for a correct positioning of the protective aid with respect to hand and wrist.

Good results have been achieved if the first engagement means comprise a first band having an adjustable length with removable locking means, coupled to said first protective element and adapted to be arranged on the back of the hand. A (first) protective padding for protecting the back of the hand may be arranged along said first band.

The second engagement means can comprise a second band of adjustable length, with removable locking means, coupled to said second protective element and adapted to be arranged on the outer side of the user's wrist. Again, a padding (second protective padding) for protecting the outer side of the wrist of the user may be arranged along the second band.

Preferably, on a surface of the first protective element a contoured reinforcement element is provided.

It is suggested that the first protective element has a first contact surface for contact with the hand palm near the wrist and the second protective element has a second contact surface for contact with the inside portion of the wrist. The first protective element can comprise a shell-like carrier member carrying said first contact surface. Correspondingly, the second protective element may comprise a shell-like carrier member carrying said second contact surface.

For high comfort for the user wearing the protective aid, one, preferably both contact surfaces may be provided with a cushioning lining attached to the respective protective element. Further, at least one of said contact surfaces can be anatomically contoured in accordance with the anatomical contour of the hand palm near the wrist or the inside portion of the wrist, respectively, to increase the comfort for the user, and to promote a correct positioning of the protective aid with respect to hand and wrist.

It is preferred that the third protective element comprises an abutment element for abutting against ground in case of a fall of a skater, to protect at least that region of the hand palm near the wrist against direct contact with ground. The abutment element may be identical with the contoured reinforcement element mentioned earlier.

Preferably, the abutment element has shock-absorption properties and a friction surface for frictional engagement with ground. With respect to the latter aspect, it is suggested that the abutment element is made from a material having a hardness providing a limited frictional engagement between said friction surface and ground so that in case of a fall of the skater a gradual deceleration of the hand contacting ground via said abutment element is achieved with respect to a movement parallel to ground. Secondary injuries induced by a sudden blockage of such a movement of the hand relative to ground accordingly are avoided.

The abutment element may be made from hard plastics, preferably having a shore hardness (shore hardness D; DIN 53505) between 58 and 70, more preferably between 61 and 67.

As has already been indicated, said first protective element may comprise a shell-like carrier member carrying said abutment element. Said shell-like member can be provided with at least one of first engagement means for engaging a hand of the skater and a first contact surface for contact with the hand palm.

According to one preferred embodiment the connecting element mentioned above directly connects the carrier member and the second protective element. Preferably, the connecting element comprises an articulation articulating the second protective element to the carrier member. Good results with respect to sufficient protection have been achieved if the carrier member at least in regions adjacent to the abutment element and the connecting element is made from hard plastics.

Said carrier member may comprise a ring-like portion for receiving a hand thumb in a ring hole, which may at least partially be made from a softer material than the rest of the carrier member to make the protective aid more comfortable for the user. Said softer material may be soft plastics.

According to a further preferred embodiment said connecting element may directly connect said abutment element and said second protective element, wherein according to a first variant said connecting element may comprise an articulation articulating the second protective element to the abutment element and, according to a second variant, the connecting element may be formed by a web portion integrally connecting said abutment element and said second protective element. It should be added that also in the above mentioned embodiment with a connecting element which directly connects the carrier member and the second protective element, the connecting element may be formed by a web portion integrally connecting the second protective element with the carrier member.

For the case of a connecting element formed by a web portion integrally connecting the respective elements and parts, it is suggested that the web portion and the elements or parts integrally connected by the web portion are sections of a one-part piece of said protective aid. For the second variant of the further preferred embodiment, specifically, it is suggested that the web portion, the abutment element, and a shell-like shield member of the second protective element are sections of a one-part piece of said protective aid.

As has already been indicated, said carrier member may comprise a ring-like portion for receiving a hand thumb in a ring hole. This applies also to the further preferred embodiment. In particular for this further embodiment, it is specifically suggested that the carrier element, at least in the region of said ring-like portion, is made from a softer material than the abutment element, with the softer material preferably being soft plastics.

As has also already been indicated, the second protective element may comprise a shell-like shield member, preferably shielding against impacts and preferably being provided with at least one of second engagement means for engaging a wrist of the skater or/and the forearm of the skater and a second contact surface for contact with the inside portion of the wrist. The shield member may be made from hard plastics.

With respect to a highly effective protection against injuries caused by hyperextension, it is suggested that the above-mentioned connecting element (possibly comprising an articulation) and the other components of the protective aid are arranged such with respect to the anatomy of the skater wearing the protective aid that the connecting element is located in the region of the distal end of the radius bone and of the "os naviculare" bone of the skater. Further, it is generally suggested that the articulation of the connecting element (if such an articulation is provided) allows a pivotal movement of the first protective element with respect to the second protective element about a pivot axis approximately orthogonal with respect to the inside portion of the wrist so that a pivotal or rotation movement of the hand in the plane of the hand is possible with respect to the wrist. Accordingly, the protective aid is very comfortable for the skater.

Again, with respect to the protection against injuries caused by hyperextension, it is suggested that the connecting element has such a stiffness or/and that said connecting element is to such an extent tension-proof and adapted to transmit tension forces between the hand and at least one of the forearm and the wrist via said first and second protective elements and associated engagement means engaging the hand and at least one of wrist and forearm that an extension movement of the hand with respect to the forearm (i.e., a pivotal movement of the hand with respect to the forearm during which the back of the hand approaches the outer side of the forearm), is retarded by the protective aid to protect against injuries in case of falls of the skater. The protective aid may also be adapted to limit the extension movement of the hand with respect to the forearm to a safe extension angle range, it is, however, preferred that the protection is achieved primarily by retardation of the extension movement at least for higher extension angle ranges, so that there is no sudden stop or blockage of the extension movement by a limit stop or the like, which could lead to discomfort or even injuries caused by such a sudden stop of the extension movement. By allowing a physiological extension movement the associated muscles are not immobilized or paralyzed so that natural reflexes are maintained, which can help to prevent injuries. By providing the mentioned retardation of the extension movement, the maintained natural reflexes can act in time so that injuries can be countered by the natural reflexes, i.e., the dynamic muscle force.

BRIEF DESCRIPTION OF THE DRAWINGS

Further characteristics and advantages of the protective aid according to the present invention will become more apparent hereinafter from the following detailed disclosure of preferred, though not exclusive, embodiments of said protective aid, which are illustrated, by way of indicative, but not limitative, examples in the figures of the accompanying drawings, where.

DESCRIPTION OF PREFERRED EMBODIMENTS

Figure 1:
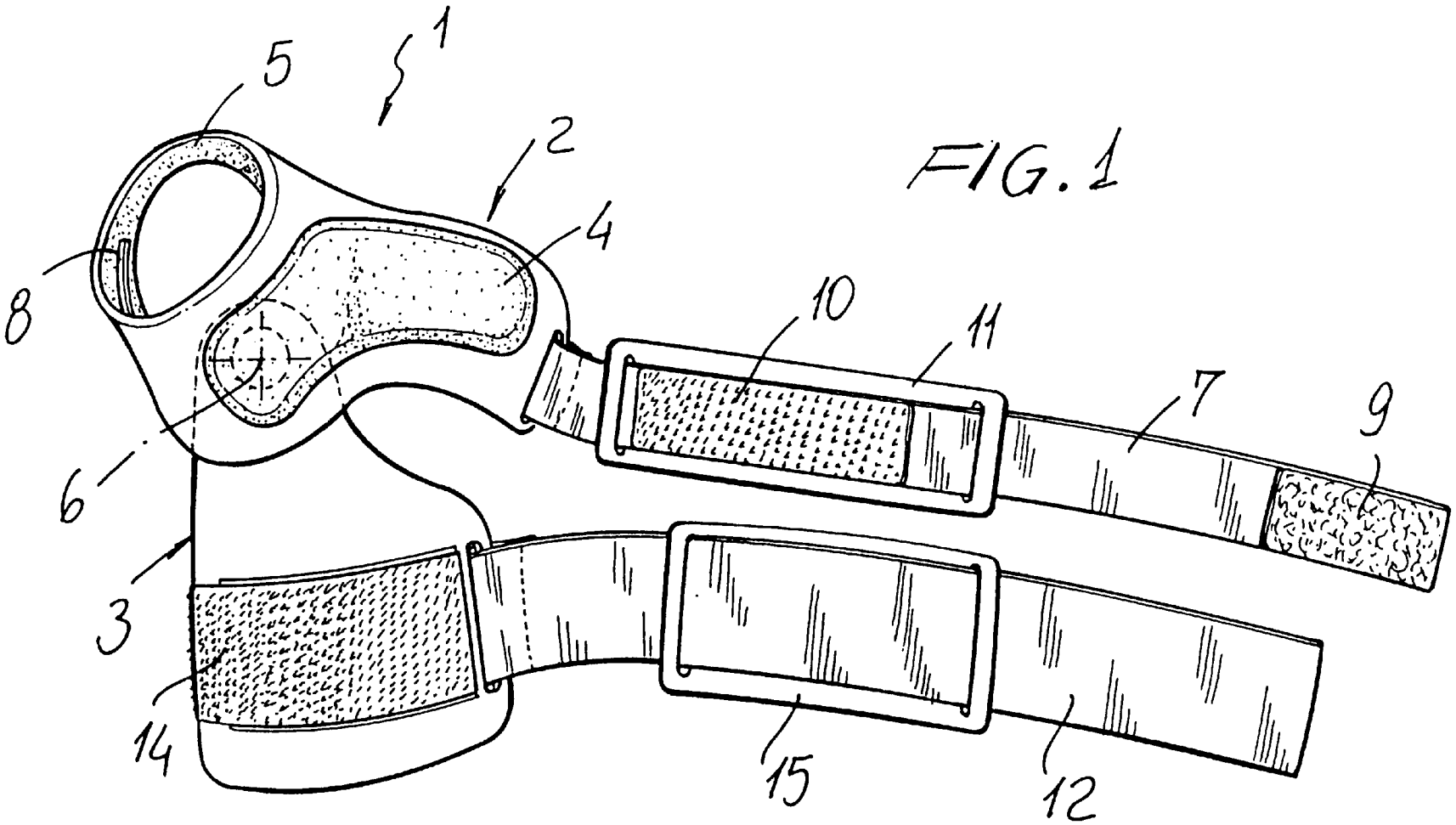
FIG. 1 is a perspective view illustrating the protective aid according to a first embodiment of the present invention.
Figure 3:
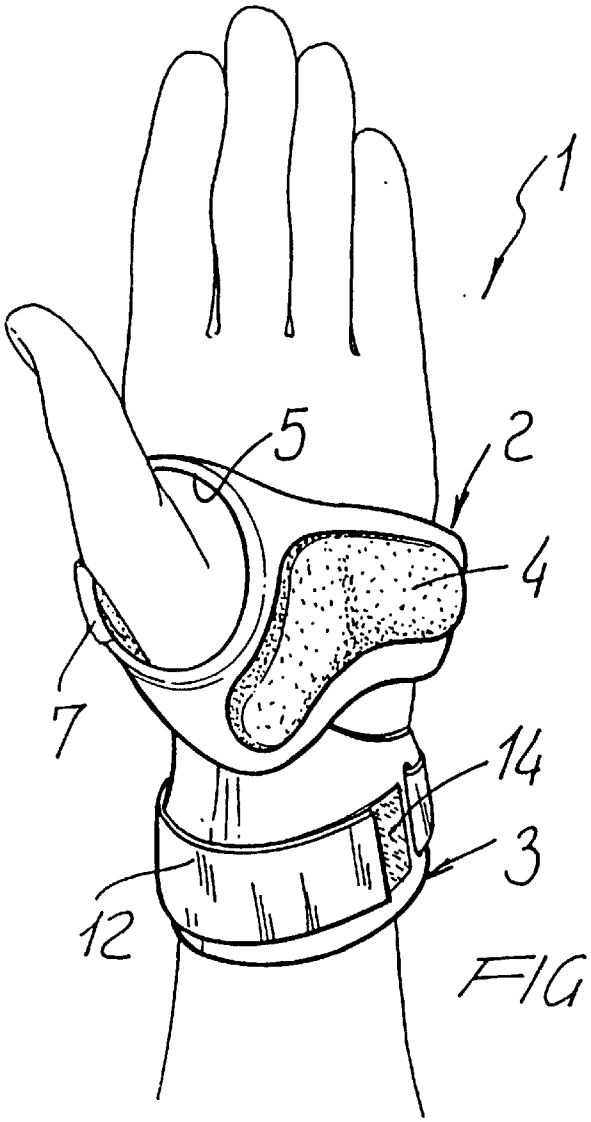
FIG. 3 illustrates the protective aid according to the first embodiment fitted on a hand of a user or skater.
Figure 2:
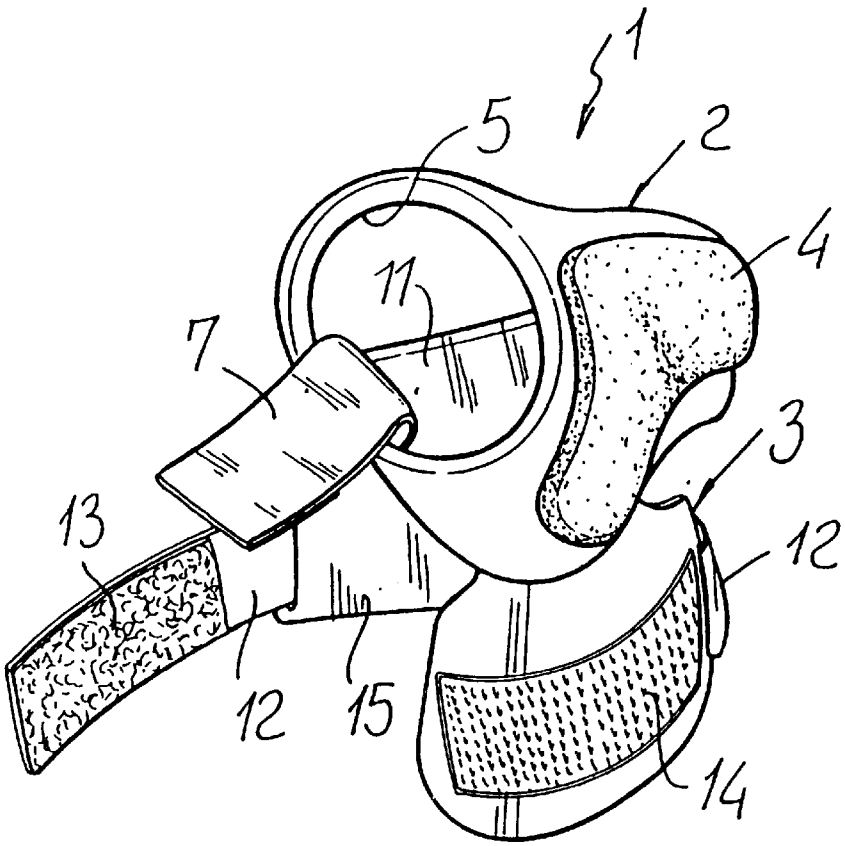
FIG. 2 is a further perspective view illustrating the protective aid according to the first embodiment as seen from a different direction.

With reference to the number references of the above mentioned FIGS. 1 to 3, the protective aid according to a first embodiment of the present invention, which has been generally indicated by the reference number 1, comprises a first shell-like protective plate 2, which is provided for being arranged on that region of the hand palm arranged near the wrist, and a second shell-like protective plate 3 to be arranged on the inside portion of the wrist.

The first protective plate 2, which is so designed as to assure a proper covering of that region of the hand palm arranged near the wrist articulation, i.e. that region which, in the case of a falling, is instinctively abutted against the ground, is provided, on the opposite face thereof, with respect to the hand, with a contoured reinforcement element 4 having shock-absorption properties and preferably being made from hard plastics. Its contoured outside surface serves as a friction surface for frictional engagement with ground and provides a gradual decelaration of the hand contacting ground via said reinforcement element 4 (also denoted as abutment element) with respect to a movement parallel to ground.

Moreover, the first protective plate 2 is so desgined and anatomically contoured that it can perfectly fit and displace with the region of the hand palm to be covered or protected. Preferably, a contact surface for contacting the hand palm is provided with a cushioning lining.

The first protective plate 2, preferably made from hard plastics, is moreover provided at a side region thereof, with a ring-like portion 5 having a passage or ring hole to be traversed by the user thumb, as the subject protective aid is fitted so as to provide a perfect self-centering of this protective plate on the hand.

The second protective plate 3, preferably made from hard plastics, has a curved configuration, which is concave on the side thereof provided for facing the inner side of the user's wrist. Preferably, a contact surface for contacting the inner side of the wrist and possibly of the forearm is provided with a cushioning lining.

As shown, the second protective plate 3 is also provided of a proper anatomical configuration, so as to properly protect the inside side of the wrist, i.e. that region thereof which is mainly subject to traumatic impacts, in the case of a falling. Accordingly, the plate 3 may also be denoted as protective shield, although the shielding of the wrist against impacts is not the primary purpose of the protection aid according to this embodiment, as will be explained later.

The second protective plate 3 is pivoted to the first protective plate 2 about a pivot element 6, which is preferably formed by a rivet connecting the two plates. The pivot element or articulation 6 is arranged in the region of the distal end of the radius bone and of the "os naviculare" bone, in particular on the axis of the radius so as to allow the first protective plate 2, and accordingly the user's hand, to freely rotate, in the plane of the hand, with respect to the wrist.

The first protective plate 2 and second protective plate 3 are provided with engagement means for engaging the user's hand and wrist.

More specifically, the mentioned engagement means comprise, for the first protective plate 2, a first band 7 which is secured with an end portion thereof to a side end portion of the first protective plate 2.

The other end portion of the first band 7 can be introduced into a slot 8, formed at the opposite side end portion (the ring-like portion) of the first protective plate 2, and it can be bent on the remaining portion of said band 7.

The first band 7, in particular, can be locked by removable locking means, preferably including a strippable strip element, of the type commercially known by the trademark "VELCRO", by coupling an element 9 of the strip near one end portion of the band 7 and the other element 10 of the strip on the rear of the band 7, on which, for achievement of this coupling, the end portion of the band 7 including the element 9 is to be arranged, so as to allow the band 7 to be easily closed on the back of the user's hand.

Along the length of the first band 7, provided for being arranged on the hand back, is arranged a protective slip 11, possibly of a padded type, in order to properly protect the back of the hand.

The engagement means of the second protective plate 3 comprise, in turn, a second band 12 which is coupled, at an end portion thereof, to a side end portion of the second protective plate 3 and which can be removably connected, along the extension therof, to the second protective plate 3, upon fitting to the wrist of the user and arranging the band 12 around the outer side of the wrist.

The removable connection of the end portion of the band 12, opposite to the end portion thereof coupled to the second protective plate 3, can be made in a similar manner to that disclosed with respect to the first band 7, by using coupling means, preferably including a strippable strip, by providing an element 13 of the strip seamed on the inside portion of the second band 12 and by coupling, for example by glueing, the other element 14 of the strip to the outer surface of the second protective plate 3.

The second band 12 can also be provided, along the extension thereof, with a protective strip 15, in order to properly protect the outer side of the wrist.

The protective strips 11 and 15 are slidably coupled to their related band 7, 12 so as to be properly arranged along the extension or length of the bands 7 and 12, depending on the user's size.

It should be apparent from the above discussion that the protective aid can be fitted in a very simple and quick manner on a hand, by introducing the hand thumb through the passage 5 and arranging the first protective plate 2 at the region of the hand palm near the wrist and by arranging the second protective plate 3 on the inside portion of the wrist.

The protective aid is firmly affixed to the hand and to the wrist by means of the bands 7 and 12, which will be closed about the hand and wrist by the strippable strips constituted by the elements 9, 10, 13 and 14.

Thus, in the case of the falling, or as the user impacts against an obstacle by the palm of his/her hand or wrist, the protective plates 2 and 3 will prevent the user from being damaged.

The mechanical strength of the first protective plate 2 is very high due to the provision of the reinforcement element 4.

In this connection it should be pointed out that the protective plates 2 and 3 can be made by molding any suitable plastics material, thereby said protective plates will have a very reduced cost.

The operation of the protective aid according to the present invention, unless being self-evident from the above discussion, will be explained in the following.

Besides the above-mentioned protection against injuring impacts against the hand palm or the inner side of the wrist by the shielding provided by the protective plate 2 (cooperating to this end with the reinforcement or abutment element 4) and by the protective plate 3, also a protection against wrist injuries caused by excessive load acting on the hand in the sense of inducing an extension movement of the hand with respect to the forearm (namely a pivot movement of the hand with respect to the forearm, during which the back of the hand approaches the outer side of the forearm) is achieved. It has been found out that during most falls of skaters (either backwards, forwards, or sideways), the skater falls onto his/her outstretched forearm, who, apparently according to a neurological reflex code, tries to avoid a direct impact of the body against ground. Such a fall on the outstretched forearm can cause by an increased leverage a high force distribution to the interior rim of the radius (the radius bone), which can lead to a radius extension fracture. Such a radius extension fracture has been described as the classical injury pattern for a fall on the outstretched forearm leading to a hyperextension of the hand with respect to the forearm.

One might think that the best way to avoid such an injuring hyperextension is to provide a protective aid having at least one stiff splint fixing the hand with respect to the forearm. Besides the effect that such a fixation of the hand with respect to the forearm is quite uncomfortable, the stiffness of the splint or splints, possibly in the form of plastic inserts in a glove-like or sleeve-like (cuff-like) textile being part of a corresponding wristguard, can create pressure points at the splint top on the forearm which can cause secondary injuries including forearm fractures.

Such a fixation of the hand with respect to the forearm against extension of the hand can also be achieved by the inventive protective aid. To this end, the components of the protective aid, in particular, the protective plates 2 and 3, in the region of the wrist and the pivot element 6 serving as a connecting element connecting the two protective plates, may be formed sufficiently stiff. However, as in the case with stiff splints, the relevant muscles would be immobilized or even paralyzed so that the natural reflexes are slowed down or at worst are even suppressed and the dynamic muscle force cannot be effective to prevent injuries.

Much better results with respect to a protection against injuries are achieved if the components of the protective aid are formed such that a limited stiffness against extension movements is achieved so that the extension movement of the hand with respect to the forearm (namely the mentioned pivot movement of the hand with respect to the forearm during which the back of the hand approaches the outer side of the forearm) is primarily retarded by the protective aid and the dynamic muscle force can work to prevent injuries. This is the case with the protective aid of FIGS. 1 to 3, which allows physiologically correct movements of the hand with respect to the forearm including extension movements at least within a certain angle range. To provide protection, excessive extension movements are primarily slowed down (and not suddenly blocked by a limit stop or the like), so that the natural reflexes, which are not suppressed, are in time to prevent injuries. The difference with respect to the case where no protective aid is worn, lies in the slowing down effect on at least excessive extension movements so that the natural reflexes which otherwise, in case of accidents often are too late to prevent injuries (the reacting time for reflexes is typically in the order of about 50 ms, in the case of the ankle joint; it appears reasonable to expect a comparable reacting time in the case of the wrist), are now in time to act before any injuries occur. Thus, the protective aid according to the first embodiment has a positive effect on the dynamical muscular stability (proprioception), which enhances the natural reflexes so that they can counter injuries in case of excessive extension movements.

To achieve the described slowing down or retarding of extension movements of the hand with respect to the forearm, the protective aid according to the first embodiment provides for a limited stiffness against bending of the protective aid in the region of the connecting element (articulation or pivot element 6) in the sense of an extension movement. Further, the connecting element and the other parts of the protective aid are tension-proof and, accordingly are adapted to transmit tension forces between the hand and the forearm and the wrist via the protective plates and the engagement means. The combined effect is that the extension movement of the hand with respect to the forearm is retarded by the protective aid to protect against injuries in case of falls of the skater.

It has to be pointed out that in case of the protective aid of FIGS. 1 to 3, those both working principles, namely the provision of counterforces against extension movement by a corresponding stiffness of the connecting element and at least neighboring parts of the protective plates and the provision of counterforces against the extension movement by transmission of tension forces between the hand and the forearm or the wrist, is realized simultaneously, with the counterforces working primarily in the sense of retarding the extension movements to achieve the positive effect on the dynamical muscular stability. However, the same effects can be achieved with either working principle alone, namely either retardation by corresponding stiffness of the connecting element and neighboring parts of the protective plates or by a corresponding transmission of tension forces between hand and forearm or wrist via the protective aid.

As can be seen from FIG. 3, the protective plate 2 engages with its part 5 the hand between the thumb and the forefinger (index finger) and there is no engagement with the fingers and the thumb itself, in particular, no transmission of tension forces between the fingers and thumb and the protective plate 2. The fingers and the thumb are basically freely movable with respect to the hand palm, as is the case when no protective aid is worn.

Figure 4:
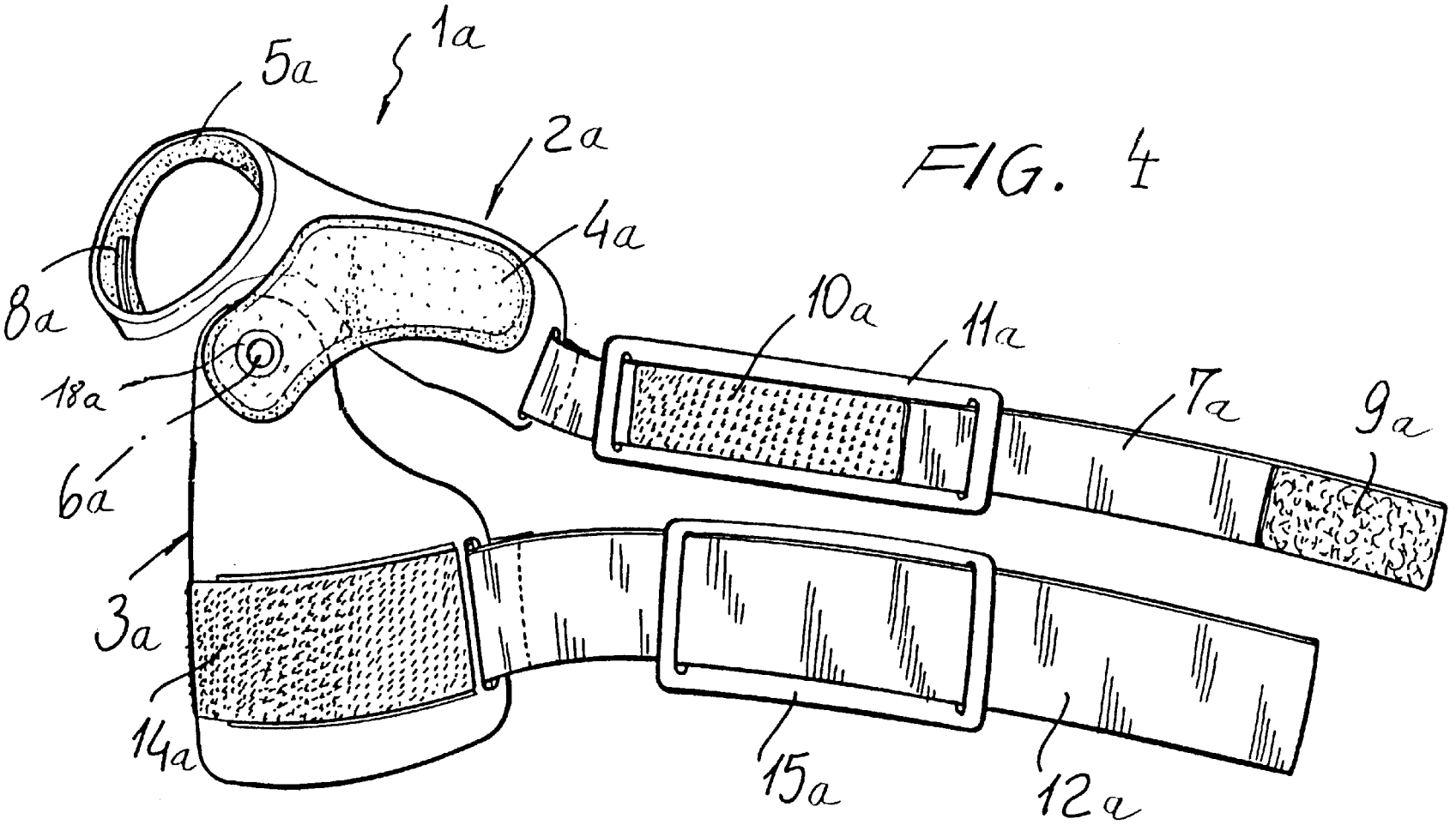
FIG. 4 is a perspective view illustrating the protective aid according to a second embodiment of the present invention.
Figure 5:
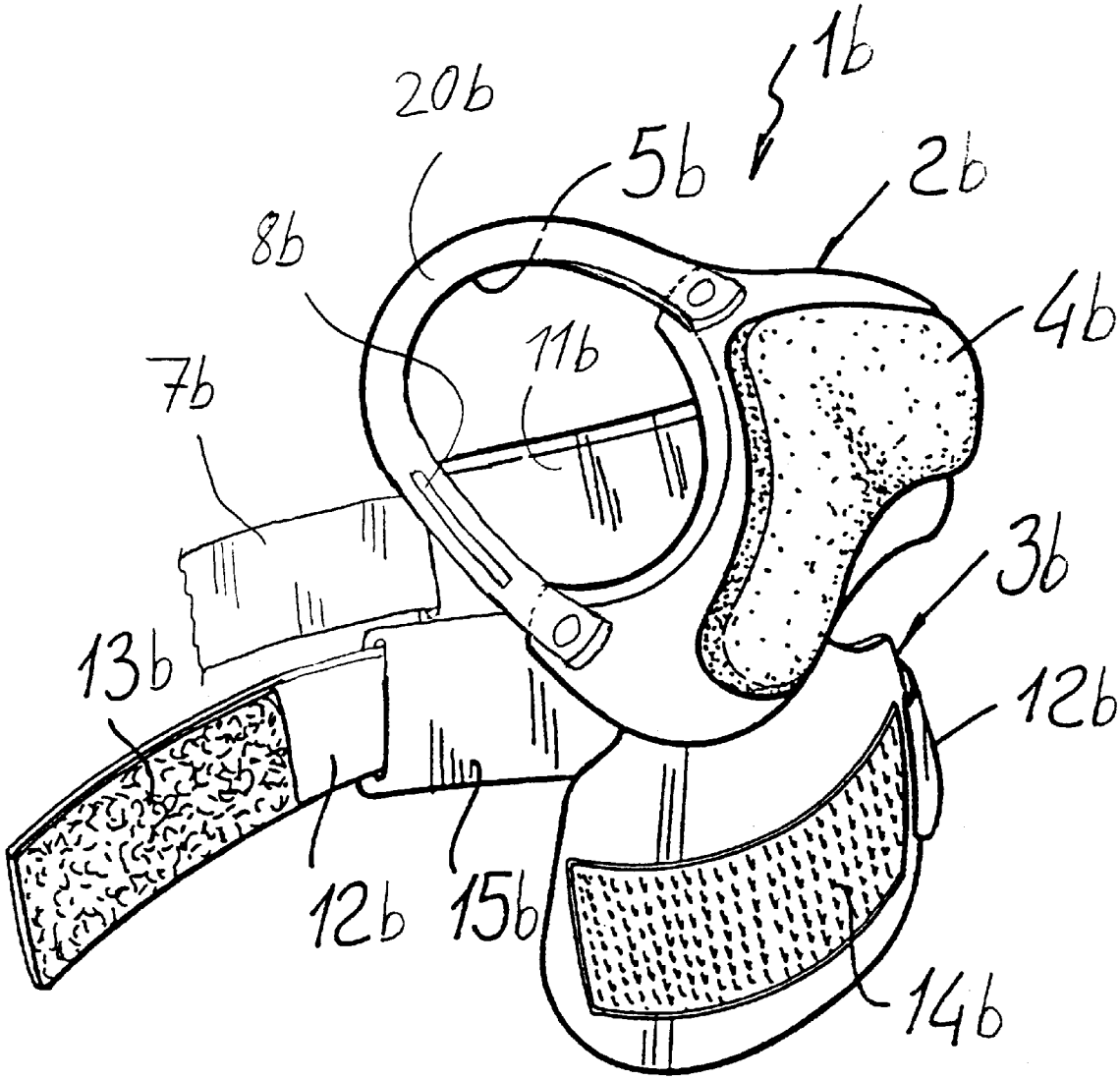
FIG. 5 is a perspective view illustrating the protective aid according to a third embodiment of the present invention, the third embodiment being only slightly modified with respect to the first embodiment and the view corresponding basically to the view of FIG. 2.
Figure 6:
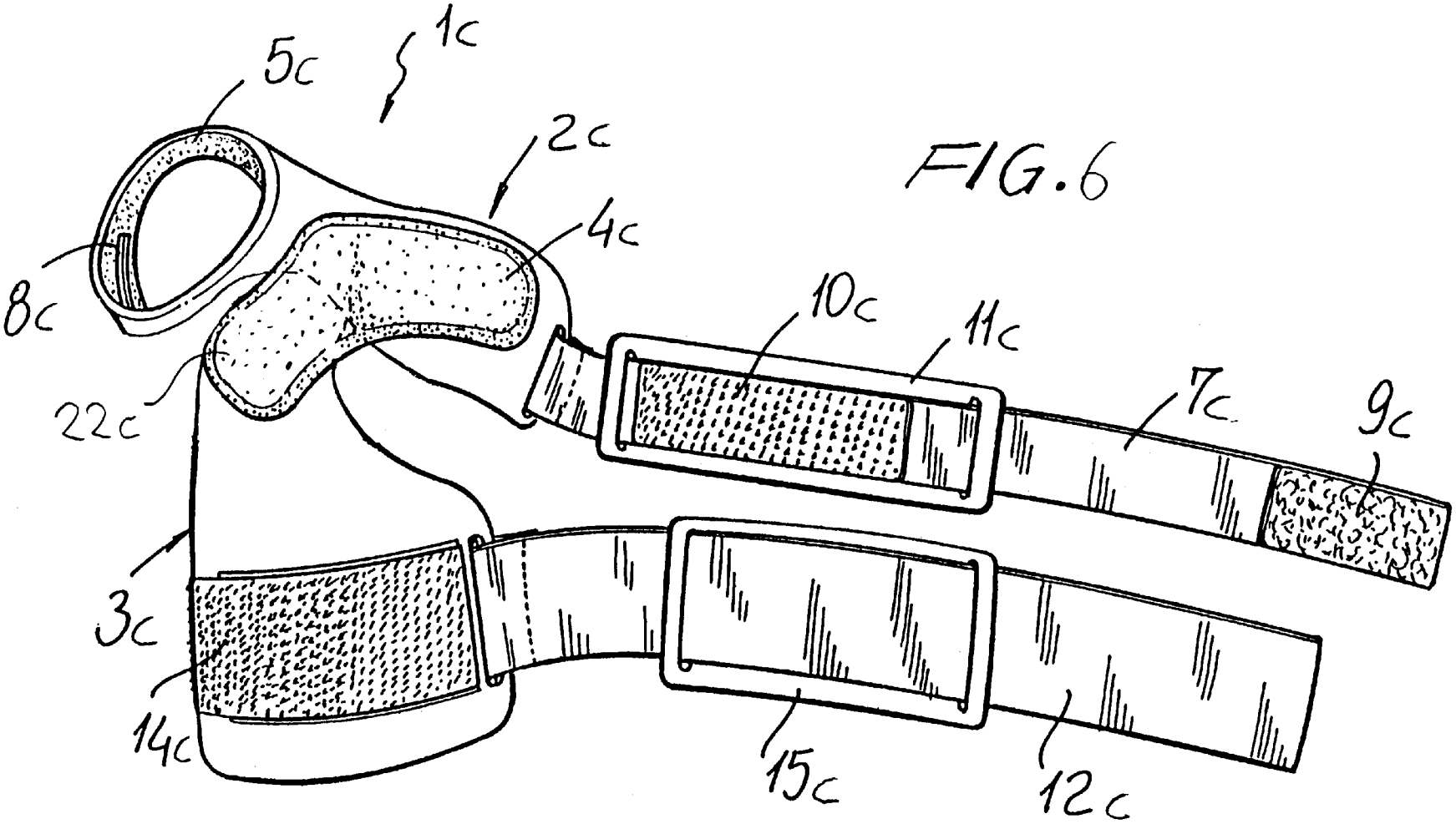
FIG. 6 is a perspective view illustrating the protective aid according to a fourth embodiment of the present invention.

With reference to FIGS. 4 to 6, three further embodiments of the protective aid according to the invention will be explained only with respect to the differences between the embodiments. In the figures, the same reference signs are used for identical or analog parts, with the reference signs being supplemented by small letters a (second embodiment, FIG. 4), b (third embodiment, FIG. 5), and c (fourth embodiment, FIG. 6) to distinguish the embodiments.

The second embodiment of FIG. 4, is distinguished from the first embodiment in that the first protective element formed by the protective aid 2*a* and the abutment 4*a* is connected at the abutment element 4*a* with the second protective element formed by the protective plate 3*a* by means of an articulation 6*a* in the form of a rivet passing through corresponding through holes of the abutment element 4*a* and the protective plate 3*a*. The abutment element 4*a*, which is basically shaped like the abutment element 4 of FIG. 1 and is made also from hard plastics, has a recess 18*a* for the outer rivet head so that the outer rivet head of the articulation 6*a* is located below the friction surface (outer surface) of the abutment element and, accordingly, will not be engaged by ground during a frictional movement of the abutment element along ground.

Also the second protective plate or shell 3*a* is shaped like the protective plate 3 of FIG. 1 and made from hard plastics. The first protective plate 2*a*, which also can be denoted as carrier element or carrier shell for the abutment element 4*a*, differs in shape from the protective plate 2 only as far as it is necessary for allowing for the direct connection of the abutment element 4*a* and the second protective plate 3*a* via the connecting element or articulation 6*a* and for a sufficient pivotal movement range of the first protective element (carrier 2*a* and abutment element 4*a*) and the second protective element (protective plate 3*a*) relative to each other. Further, the carrier element 2*a* differs from the carrier element or protective element 2*a* of FIG. 2 in that the carrier element 2*a* is made from soft plastics, which is more comfortable for the skater. In particular, a possibly annoying pressure point between the thumb and the forefinger is avoided. However, this could also be achieved by only forming the ring portion 5*a* from soft plastics and forming the rest of the carrier element from a harder material, in particular, hard plastics like the hard plastics of the protective plate 3*a*.

In view of the above transmission of tension forces between hand and wrist or forearm by means of the protective aid to achieve the positive effect on the dynamical muscular stability by slowing down of at least excessive extension movements, the soft parts of the first protective element, in particular the ring portion 5*a*, can be reinforced by an insert, for example, an insert in the form of tension-proof wire embedded within the soft material and anchored within or on the harder sections of the carrier element 2*a* or the abutment element. However, the softness and flexibility of the carrier element 2*a*, in particular of the ring portion 5*a*, can be chosen so that even without such reinforcements tension forces are transmitted to a sufficient extent between hand and forearm or wrist to achieve the desired slowing down of extension movements. Possibly, the adjoining parts of the abutment element 4*a* and protective plate 3*a* forming together with the articulation 6*a* a connecting element connecting the abutment element 4*a* and the protective plate 3*a*, can be made stiffer or more rigid to compensate for a reduced force transmitting capability of the protective aid so that the same slowing down effect on extension movements is achieved as in the case of the first embodiment.

The third embodiment shown in FIG. 5 corresponds basically to the first embodiment of FIGS. 1, 2 and 3. The only difference is that the ring portion 5*b* is formed with a softer (softer than the rest of the first protective plate 2*b*) band to be arranged around the thumb and being riveted at its two ends to the protective plate 2*b*. This band 20*b* provides for more comfort, in particular, with respect to pressure points between the thumb and the forefinger. If the transmission of tension forces between the hand and the wrist or forearm is desired, a reinforcement wire or the like may be embedded within the band 20*b*, which wire is anchored at the protective plate 2*b* possibly by means of the two rivets connecting the band 20*b* with the protective plate 2*b*.

FIG. 6 shows a modification of the second embodiment shown in FIG. 4. In the fourth embodiment of FIG. 6, the abutment element 4*c* and the second protective plate 3*c* are directly connected without any articulation or the like. The connecting element connecting the abutment element 4*b* and the protective plate 3*c* is formed by a web portion 22*c* integrally connecting said abutment element and said second protective element. In the embodiment shown, said web portion 22*c*, said abutment element 4*c* and said protective plate 3*c* are sections of a one-part piece of the protective aid. The protective aid of FIG. 6 may be slightly less comfortable compared with the protective aid of FIG. 4, since no free rotation of the user's hand in the plane of the hand with respect to the wrist is possible. However, the protection properties of the protective aid are not adversily affected.

The part comprising the protective plate 3*c*, the web portion 22*c* and the abutment element 4*c* can advantageously made by injection molding, preferably from polycarbonate plastics. In particular, the polycarbon plastics material known under the trademark MAKROLON and manufactured by Bayer is well suited for manufacturing the mentioned components. MAKROLON is a high-viscosity impact-modified polycarbonate with an extraordinary low-temperature strength. It has an ultimate tensile strength of 55 $N/mm^2$ and no failures were noted during impact strength tests (CHARPY) at 23° C. and −40° C. for specimens of 50 mm–6 mm–4 mm. Also for the other embodiments, the material polycarbonate can be used advantageously, in particular for the elements 2, 3; 2*a*, 3*a*; 2*b*, 3*b* as well as the abutment element 4; 4*a*; 4*b*; 4*c*, with the hardness of the abutment element being preferably selected to provide the mentioned gradual braking or deceleration of the hand contacting ground via said abutment element with respect to a movement parallel to ground in case of falls of the skater. Accordingly, a sudden blockage of the movement of the hand is avoided. Such a sudden blockage of the hand movement relative to the ground could lead to injuries, since in this case the body might be slung over the hand forwards with overextension of the wrist and the danger of other injuries, for instance, the chin. However, instead of using polycarbonate plastics for the manufacturing of the abutment element it is even more preferred to manufacture the abutment element from thermoplastic elastomeric polyurethane (TPU) having a shore hardness D in the order of 64 (DIN 53505), to achieve a good shock absorption characteristic and to achieve the mentioned gradual braking or deceleration of the hand contacting ground via said abutment element with respect to the movement parallel to ground.

With respect to the embodiments having an articulation between the first protective element and the second protective element, it should be added that an articulation could alternatively be provided by means of a reduction of material without any articulated pin element (like rivets 6 and 6*a*) engaging in a recess of the first protective element or the second protective element.

It should be added that the protective aid which may also be denoted as wrist guard, may be provided with an additional protective element to be arranged on the back of the hand, which serves to protect the back of the hand against impacts. With respect to the protection against injuring extension movements, such an additional protective element on the back of the hand can be dispensed with.

From the above disclosure and from the observations of the figures of the accompanying drawings, it should be apparent that the invention fully achieves the intended aim and objects.

In particular, the fact is to be pointed out that a protective aid or device has been provided for properly protecting a user's hand and wrist, particularly designed for skaters, which is very reliably in operation, preventing the user from being damaged during fallings, or during impacts against obstacles.

While the invention has been disclosed and illustrated with refernce to a preferred embodiment thereof, it should be apparent that the disclosed embodiment is susceptible to several modifications and variations, all of which will come within the spirit and scope of the invention.

The present invention relates to a protective aid for protecting the hands and wrists of skaters, which comprises a first protective element to be arranged on that region of the hand palm situated near the wrist. The protective aid comprises moreover a second protective element which can be arranged on the inside portion of the wrist and which is connected to the first protective plate via a connecting element.

The protective aid is provided with engagement means for engaging the hand and/or wrist of the user, in order to firmly connect the protective aid to the user's hand, during use.

What is claimed is:

1. A protective aid (1) for protecting a hand and wrist of a skater, said protective aid comprising a first protective element (2, 4) which can be arranged on that region of the hand palm near the wrist, and a second protective element (3) which can be arranged on the inside portion of the wrist and is connected via a connecting element (6; 6*a*; 22*c*) with the first protective element, said protective aid being provided with engagement means (7, 12, 5) for engaging at least one of a hand and a wrist of the skater, said engagement means (7, 12, 5) comprise at least one of a band (7) associated with the first protective element (2,4) for engaging a hand of the skater and a band (12) associated with the second protective element (3) for engaging a wrist of the skater, the respective band (7,12) having an adjustable length and being provided with removable locking means (8, 9, 10, 13, 14), the respective band (7,12) being adapted to be arranged on a back of the hand or on the outer side of the user's wrist, respectively, the respective band (7,12) or at least one of said bands (7,12) having associated a protective padding (11,15) to be arranged along the respective band (7,12) for protecting the back of the hand or the outer site of said user's wrist, respectively.

2. A protective aid according to claim 1, characterized in that said first protective element comprises a first protective plate (2) and said second protective element comprises a second protective plate (3).

3. A protective aid according to claim 1, characterized in that said engagement means comprise at a side region of the first protective element a ring-like portion (5) for receiving a hand thumb in a ring hole and having self-centering properties.

4. A protective aid according to claim 1, characterized in that said connecting element comprises an articulation (6,6*a*).

5. A protective aid according to claim 1, characterized in that said second protective element comprises a shell-like shield member (3) provided with at least one of second engagement means (12) for engaging a wrist of the skater and a second contact surface for contact with the inside portion of the wrist.

6. A protective aid according to claim 5, characterized in that said shield member is made from hard plastics.

7. A protective aid according to claim 1, characterized by said connecting element (6; 6*a*; 22*c*) and the other components of the protective aid (1; 1*a*; 1*b*; 1*c*) being arranged such with respect to the anatomy of the skater wearing the protective aid that the connecting element is located in the region of the distal end of the radius bone and of the "os naviculare" bone of the skater.

8. A protective aid according to claim 7, characterized in that said connecting element comprises an articulation (6; 6*a*) allowing a pivot movement of the first protective element (2, 4; 2*a*, 4*a*; 2*b*; 4*b*) with respect to the second protective element (3; 3*a*; 3*b*) about a pivot axis approximately orthogonal with respect to the inside portion of the wrist.

9. A protective aid according to claim 7, characterized by at least one of said connecting element (6; 6*a*; 22*c*) having such a stiffness and said connecting element (6; 6*a*; 22*c*) being to such an extent tension-proof and adapted to transmit tension forces between the hand and at least one of the forearm and the wrist via said first and second protective elements (2, 4, 3; 2*a*, 4*a*, 3*a*; 2*b*, 4*b*, 3*b*; 2*c*, 4*c*, 3*c*) and associated engagement means (5, 7, 12; 5*a*, 7*a*, 12*a*; 5*b*, 7*b*, 12*b*; 5*c*, 7*c*, 12*c*) engaging the hand and at least one of wrist and forearm, that an extension movement of the hand with respect to the forearm, namely a pivot movement of the hand with respect to the forearm during which the back of the hand approaches the outer side of the forearm is retarded by the protective aid (1; 1*a*; 1*b*; 1*c*) to protect against injuries in case of falls of the skater.

10. A protective aid (1) for protecting a hand and wrist of a skater, said protective aid comprising in a first protective element (2, 4) which can be arranged on that region of the hand palm near the wrist, and a second protective element (3) which can be arranged on the inside portion of the wrist and is connected via a connecting element (6; 6*a*; 22*c*) with the first protective element, said protective aid being provided with engagement means (7, 12, 5) for engaging at least one of a hand and a wrist of the skater, wherein said first protective element (2) is provided, on a surface thereof opposite to said hand, with a contoured reinforcement element (4).

11. A protective aid according to claim 10, characterized in that said first protective element comprises a first protective plate (2) and said second protective element comprises a second protective plate (3).

12. A protective aid according to claim 10, characterized in that said engagement means comprise first engagement means (7, 5) associated with the first protective element (2, 4) for engaging a hand of the skater.

13. A protective aid according to claim 11, characterized in that said engagement means comprises second engagement means (12) associated with the second protective element (3) for engaging a wrist of the skater.

14. A protective aid according to claim 12, characterized in that said first engagement means comprise at a side region of the first protective element a ring-like portion (5) for receiving a hand thumb in a ring hole and having self-centering properties.

15. A protective aid according to claim 12, characterized in that said first engagement means comprise a first band (7) having an adjustable length, with removable locking means (8, 9, 10), coupled to said first protective element and adapted to be arranged on a back of the hand.

16. A protective aid according to claim 13, characterized in that said second engagement means comprise a second band (12) of adjustable length, with removable locking means (13, 14), coupled to said second protective element (3) and adapted to be arranged on the outer side of the user's wrist.

17. A protective aid according to claim 10, characterized in that said reinforcement element serves as an abutment element (4) for abutting against ground in case of a fall of the skater and protecting at least that region of the hand palm near the wrist against direct contact with the ground.

18. A protective aid according to claim 17, characterized in that said reinforcement element (4) has shock-absorption properties.

19. A protective aid according to claim 18, characterized in that said reinforcement element (4) has a friction surface for frictional engagement with ground.

20. A protective aid according to claim 19, characterized in that said reinforcement element (4) is made from a material having a hardness providing a limited frictional engagement between said friction surface and ground so that in case of fall of the skater a gradual deceleration of the hand contacting ground via said reinforcement element is achieved with respect to a movement parallel to ground.

21. A protective aid according to claim 17, characterized in that said reinforcement element (4) is made from hard plastics.

22. A protective aid according to claims 17, characterized in that said reinforcement element (4) is made from hard plastics having a shore hardness (shore hardness D, DIN 53505) between 58 and 70.

23. A protective aid according to claim 17, characterized in that said reinforcement element (4) is made from hard plastics having a shore hardness (shore hardness D, DIN 53505) between 61 and 67.

24. A protective aid according to claim 10, characterized by, said connecting element (6*a*; 22*c*) directly connecting said reinforcement element (4*a*; 4*c*) and said second protective element (3*a*; 3*c*).

25. A protective aid according to claim 10, characterized in that said connecting element comprises an articulation (6*a*) articulating the second protective element (3*a*) to the reinforcement element (4*a*).

26. A protective aid according to claim 24, characterized in that said connecting element, is formed by a web portion (22*c*) integrally connecting said reinforcement element (4*c*) and said second protective element (3*c*).

27. A protective aid according to claim 26, characterized in that said web portion (22*c*), said reinforcement element (4*c*) and a shell-like shield member (3*c*) of said second protective element are sections of a one-part piece of said protective aid (1c).

28. A protective aid according to claim 10, characterized in that said second protective element comprises a shell-like member (3) provided with a least one of second engagement means (12) for engaging a wrist of the skater and a second contact surface for contact with the inside portion of the wrist.

29. A protective aid according to claim 28, characterized in that said shield member is made from hard plastics.

30. A protective aid according to claim 10, characterized by said connecting element (6; 6*a*; 22*c*) and the other components of the protective aid (1; 1*a*; 1*b*; 1*c*) being arranged such with respect to the anatomy of the skater wearing the protective aid that the connecting element is located in the region of the distal end of the radius bone and of the "os naviculare" bone of the skater.

31. A protective aid according to claim 30, characterized in that said connecting element comprises an articulation (6; 6*a*) allowing a pivot movement of the first protective element (2, 4; 2*a*; 4*a*; 2*b*; 4*b*) with respect to the second protective element (3; 3*a*; 3*b*) about a pivot axis approximately orthogonal with respect to the inside portion of the wrist.

32. A protective aid according to claim 30, characterized by at least one of said connecting element (6; 6*a*; 22*c*) having such a stiffness and said connecting element (6; 6*a*; 22*c*) being to such an extent tension-proof and adapted to transmit tension forces between the hand and at least one of the forearm and the wrist via said first and second protective elements (2, 4, 3; 2*a*, 4*a*, 3*a*: 2*b*, 4*b*, 3*b*; 2*c*, 4*c*, 3*c*) and associated engagement means (5, 7, 12; 5*a*, 7*a*, 12*a*; 5*b*, 7*b*, 12*b*; 5*c*, 7*c*, 12*c*) engaging in the hand and at least one of wrist and forearm, that an extension movement of the hand with respect to the forearm, namely a pivot movement of the hand with respect to the forearm during which the back of the hand approaches the outer side of the forearm is retarded by the protective aid (1; 1*a*; 1*b*; 1*c*) to protect against injuries in case of falls of the skater.

33. A protective aid (1) for protecting a hand and wrist of a skater, said protective aid comprising a first protective element (2, 4) which can be arranged on that region of the hand palm near the wrist, and a second protective element (3) which can be arranged on the inside portion of the wrist and is connected via a connecting element (6; 6*a*; 22*c*) with the first protective element, said protective aid being provided with engagement means (7, 12, 5) for engaging at least one of a hand and wrist of the skater, wherein said first protective element (2, 4) has a first contact surface for contact with the hand palm near the wrist and said second protective element (3) has a second contact surface for contact with the inside portion of the wrist wherein at least one of said contact surfaces is provided with a cushioning lining attached to the respective protective element.

34. A protective aid according to claim 33, characterized in that said first protective element comprises a first protective plate; (2) and said second protective element comprises a second protective plate (3).

35. A protective aid according to claim 33, characterized in that said engagement means comprise first engagement means (7, 5) associated with the first protective element (2, 4) for engaging a hand of the skater.

36. A protective aid according to claim 34, characterized in that said engagement means comprises second engagement means (12) associated with the second protective element (3) for engaging a wrist of the skater.

37. A protective aid according to claim 35, characterized in that said first engagement means comprise at a side region of the first protective element a ring like portion (5) for receiving a hand thumb in a ring hole and having self-centering properties.

38. A protective aid according to claim 35, characterized in that said first engagement means comprise a first band (7) having an adjustable length, with removable locking means (8, 9, 10), coupled to said first protective element and adapted to be arranged on a back of the hand.

39. A protective aid according to claim 36, characterized in that said second engagement means comprise a second band (12) of adjustable length, with removable locking means (13, 14), coupled to said second protective element (3) and adapted to be arranged on the outer side of the user's wrist.

40. A protective aid according to claim 33, characterized in that said connecting element comprises an articulation (6; 6*a*).

41. A protective aid (1) for protecting a hand and wrist of a skater, said protective aid comprising a first protective element (2, 4) which can be arranged on that region of the hand palm near the wrist, and a second protective element (3) which can be arranged on the inside portion of the wrist and is connected via a connecting element (6; 6*a*; 22*c*) with the first protective element, said protective aid being provided with engagement means (7, 12, 5) for engaging at least one of a hand and a wrist of the skater, wherein said first protective element (2, 4) comprises an abutment element (4) for abutting against ground in case of a fall of the skater and protecting at least that region of the hand palm near the wrist against direct contact with the ground, wherein said first protective element (2, 4) comprises a shell-like carrier member (2) carrying said abutment element (4) and being provided with at least one of first engagement means (5, 7) for engaging a hand of the skater and a first contact surface for contact with the hand palm.

42. A protective aid according to claim 41, characterized in that said first protective element comprises a first protective plate (2) and said second protective element comprises a second protective plate (3).

43. A protective aid according to claim 41, characterized in that said engagement means comprise first engagement means (7, 5) associated with the first protective element (2, 4) for engaging a hand of the skater.

44. A protective aid according to claim 42, characterized in that said engagement means comprises second engagement means (12) associated with the second protective element (3) for engaging a wrist of the skater.

45. A protective aid according to claim 43, characterized in that said first engagement means comprise at a side region of the first protective element a ring-like portion (5) for receiving a hand thumb in a ring hole and having self-centering properties.

46. A protective aid according to claim 43, characterized in that said first engagement means comprise a first band (7) having an adjustable length, with removable locking means (8, 9, 10,), coupled to said first protective element and adapted to be arranged on a back of the hand.

47. A protective aid according to claim 44, characterized in that said second engagement means comprise a second band (12) of adjustable length, with removable locking means (13, 14), coupled to said second protective element (3) and adapted to be arranged on the outer side of the user's wrist.

48. A protective aid according to claim 41, characterized in that said abutment element (4) has shock-absorption properties.

49. A protective aid according to claim 48, characterized in that said abutment element (4) has a friction surface for frictional engagement with ground.

50. A protective aid according to claim 49, characterized in that said abutment element (4) is made from a material having a hardness providing a limited frictional engagement between said friction surface and ground so that in case of fall of the skater a gradual deceleration of the hand contacting ground via said abutment element is achieved with respect to a movement parallel to ground.

51. A protective aid according to claim 41, characterized in that said abutment element (4) is made from hard plastics.

52. A protective aid according to claim 41, characterized in that said abutment element (4) is made from hard plastics having a shore hardness (shore hardness D, DIN 53505) between 58 and 70.

53. A protective aid according to claim 41, characterized in that said abutment element (4) is made from hard plastics having a shore hardness (shore hardness D, DIN 53505) between 61 and 67.

54. A protective aid according to claim 41, characterized by said connecting element (6) directly connecting said carrier member (2) and said second protective element (3).

55. A protective aid according to claim 54, characterized in that said connecting element comprises an articulation (6) articulating the second protective element (3) to the carrier member (2).

56. A protective aid according to claim 54, characterized in that said carrier member (2), at least in regions adjacent to the abutment element (4) and the connecting element (6), is made from hard plastics.

57. A protective aid according to claim 56, characterized in that said carrier member (2*b*) comprises a ring-like portion (5*b*) for receiving a hand thumb in a ring hole and at least partially being made from a softer material than the rest of the carrier member (2*b*).

58. A protective aid according to claim 57, characterized in that said softer material is soft plastics.

59. A protective aid according to claim 41, characterized by said connecting element (6*a*; (22*c*) directly connecting said abutment element (4*a*; 4*c*) and said second protective element (3*a*; 3*c*).

60. A protective aid according to claim 59, characterized in that said connecting element comprises an articulation (6*a*) articulating the second protective element (3*a*) to the abutment element (4*a*).

61. A protective aid according to claim 59, characterized in that said connecting element is formed by a web portion (22*c*) integrally connecting said abutment element (4*c*) and said second protective element (3*c*).

62. A protective aid according to claim 61, characterized in that said web portion (22*c*), said abutment element (4*c*) and a shell-like shield member (3*c*) of said second protective element are sections of a one-part piece of said protective aid (1*c*).

63. A protective aid according to claim 59, characterized in that said carrier member (2*a*; 2*c*) comprises a ring-like portion (5*a*; 5*c*) for receiving a hand thumb in a ring hole and in that said carrier member, at least in the region of said ring-like portion, is made from a softer material than the abutment element (4*a*; 4*c*).

64. A protective aid according to claim 63, characterized in that said softer material is soft plastics.

65. A protective aid according to claim 41, characterized in that said second protective element comprises a shell-like shield member (3) provided with at least one of second engagement means (12) for engaging a wrist of the skater and a second contact surface for contact with the inside portion of the wrist.

66. A protective aid according to claim 65, characterized in that said shield member is made from hard plastics.

67. A protective aid according to claim 41, characterized by said connecting element (6; 6*a*; 22*c*) and the other components of the protective aid (1; 1*a*; 1*b*; 1*c*) being arranged such with respect to the anatomy of the skater wearing the protective aid that the connecting element is located in the region of the distal end of the radius bone and of the "os naviculare" bone of the skater.

68. A protective aid according to claim 67, characterized in that said connecting element comprises an articulation (6; 6*a*) allowing a pivot movement of the first protective element (2, 4; 2*a*, 4*a*; 2*b*; 4*b*) with respect to the second protective element (3; 3*a*; 3*b*) about a pivot axis approximately orthogonal with respect to the inside portion of the wrist.

69. A protective aid according to claim 67, characterized by at least one of said connecting element (6; 6*a*: 22*c*) having such a stiffness and said connecting element (6; 6*a*; 22*c*) being to such an extent tension-proof and adapted to transmit tension forces between the hand and at least one of the forearm and the wrist via said first and second protective elements (2, 4, 3; 2*a*, 4*a*, 3*a*; 2*b*, 4*b*, 3*b*; 2*c*, 4*c*, 3*c*) and associated engagement means (5, 7, 12; 5*a*, 7*a*, 12*a*; 5*b*, 7*b*, 12*b*; 5*c*, 7*c*, 12*c*) engaging the hand and at least one of wrist and forearm, that an extension movement of the hand with respect to the forearm, namely a pivot movement of the hand with respect to the forearm during which the back of the hand approaches the outer side of the forearm is retarded by the protective aid (1; 1*a*: 1*b*; 1*c*) to protect against injuries in case of falls of the skater.

70. A protective aid (1) for protecting a hand and wrist of a skater, said protective aid comprising a first protective element (2, 4) which can be arranged on that region of the hand palm near the wrist, and a second protective element (3) which can be arranged on the inside portion of the wrist and is connected via a connecting element (6; 6*a*; 22*c*) with the first protective element, said protective aid being provided with engagement means (7, 12, 5) for engaging at least one of a hand and a wrist of the skater, wherein said first protective element (2, 4) comprises an abutment element (4) for abutting against ground in case of a fall of the skater and protecting at least that region of the hand palm near the wrist against direct contact with the ground, wherein said abutment element (4) has shock-absorption properties and a larger thickness than a shell-like shield member (3) of the second protective element, so as to protect that region of the hand palm near the wrist against impact-injuries.

71. A protective aid according to claim 70, characterized in that said first protective element comprises a first protective plate (2) and said second protective element comprises a second protective plate (3).

72. A protective aid according to claim 70, characterized in that said engagement means comprise first engagement means (7, 5) associated with the first protective element (2, 4) for engaging a hand of the skater.

73. A protective aid according to claim 71, characterized in that said engagement means comprises second engagement means (12) associated with the second protective element (3) for engaging a wrist of the skater.

74. A protective aid according to claim 72, characterized in that said first engagement means comprise at a side region of the first protective element a ring-like portion (5) for receiving a hand thumb in a ring hole and having self-centering properties.

75. A protective aid according to claim 72, characterized in that said first engagement means comprise a first band (7) having an adjustable length, with removable locking means (8, 9, 10), coupled to said first protective element and adapted to be arranged on a back of the hand.

76. A protective aid according to claim 73, characterized in that said second engagement means comprise a second band (12) of adjustable length, with removable locking means (13, 14) coupled to said second protective element (3) and adapted to be arranged on the outer side of the user's wrist.

77. A protective aid according to claim 70, characterized in that said abutment element (4) has a friction surface for frictional engagement with ground.

78. A protective aid according to claim 77, characterized in that said abutment element (4) is made from a material having a hardness providing a limited frictional engagement between said friction surface and ground so that in case of fall of the skater a gradual deceleration of the hand contacting ground via said abutment element is achieved with respect to a movement parallel to ground.

79. A protective aid according to claim 70, characterized in that said abutment element (4) is made from hard plastics.

80. A protective aid according to claim 70, characterized in that said abutment element (4) is made from hard plastics having a shore hardness (shore hardness D, DIN 53505) between 58 and 70.

81. A protective aid according to claim 70, characterized in that said abutment element (4) is made from hard plastics having a shore hardness (shore hardness D, DIN 53505) between 61 and 67.

82. A protective aid according to claim 70, characterized in that said first protective element (2, 4) comprises a shell-like carrier member (2) carrying said abutment element (4) and being provided with at least one of first engagement means (5, 7) for engaging a hand of the skater and a first contact surface for contact with the hand palm.

83. A protective aid according to claim 82, characterized by said connecting element (6) directly connecting said carrier member (2) and said second protective element (3).

84. A protective aid according to claim 83, characterized in that said connecting element comprises an articulation (6) articulating the second protective element (3) to the carrier member (2).

85. A protective aid according to claim 83, characterized in that said carrier member (2), at least in regions adjacent to the abutment element (4) and the connecting element (6), is made from hard plastics.

86. A protective aid according to claim 84, characterized in that said carrier member (2*b*) comprises a ring-like portion (5*b*) for receiving a hand thumb in a ring hole and at least partially being made from a softer material than the rest of the carrier member (2*b*).

87. A protective aid according to claim 86, characterized in that said softer material is soft plastics.

88. A protective aid according to claim 82, characterized by said connecting element (6*a*; 22*c*) directly connecting said abutment element (4*a*; 4*c*) and said second protective element (3*a*; 3*c*).

89. A protective aid according to claim 88, characterized in that said connecting element comprises an articulation (6*a*) articulating the second protective element (3*a*) to the abutment element (4*a*).

90. A protective aid according to claim 88, characterized in that said connecting element is formed by a web portion (22*c*) integrally connecting said abutment element (4*c*) and said second protective element (3*c*).

91. A protective aid according to claim 90, characterized in that said web portion (22*c*), said abutment element (4*c*) and a shell-like shield member (3*c*) of said protective element are sections of a one-part piece of said protective aid (1*c*).

92. A protective aid according to claim 88, characterized in that said carrier member (2*a*; 2*c*) comprises a ring-like portion (5*a*; 5*c*) for receiving a hand thumb in a ring hole and in that said carrier member, at least in the region of said ring-like portion, is made from a softer material than the abutment element (4*a*; 4*c*).

93. A protective aid according to claim 92, characterized in that said softer material is soft plastics.

94. A protective aid according to claim 70, characterized in that said second protective element comprises a shell-like shield member (3) provided with at least one of second engagement means (12) for engaging a wrist of the skater and a second contact surface for contact with the inside portion of the wrist.

95. A protective aid according to claim 94, characterized in that said shield member is made from hard plastics.

96. A protective aid according to claim 70, characterized by said connecting element (6; 6*a*; 22*c*) and the other components of the protective aid (1; 1*a*; 1*b*; 1*c*) being arranged such with respect to the anatomy of the skater wearing the protective aid that the connecting element is located in the region of the distal end of the radius bone and of the "os naviculare" bone of the skater.

97. A protective aid according to claim 96, characterized in that said connecting element comprises an articulation (6; 6*a*) allowing a pivot movement of the first protective element (2, 4; 2*a*, 4*a*; 2*b*; 4*b*) with respect to the second protective element (3; 3*a*; 3*b*) about a pivot axis approximately orthogonal with respect to the inside portion of the wrist.

98. A protective aid according to claim 96, characterized by at least one of said connecting element (6; 6*a*, 22*c*) having such a stiffness and said connecting element (6; 6*a*; 22*c*) being to such an extent tension-proof and adapted to transmit tension forces between the hand and at least one of the forearm and the wrist via said first and second protective elements (2, 4, 3; 2*a*, 4*a*, 3*a*; 2*b*, 4*b*, 3*b*; 2*c*, 4*c*, 3*c*) and associated engagement means (5,7,12; 5*a*, 7*a*, 12*a*; 5*b*, 7*b*, 12*b*; 5*c*, 7*c*, 12*c*) engaging the hand and at least one of wrist and forearm, that an extension movement of the hand with respect to the forearm, namely a pivot movement of the hand with respect to the forearm during which the back of the hand approaches the outer side of the forearm is retarded by the protective aid (1; 1*a*; 1*b*; 1*c*) to protect against injuries in case of falls of the skater.

99. A protective aid (1) for protecting a hand and a wrist of a skater, said protective aid comprising:

a first protective element (2,4) adapted to be arranged on that region of the hand near the wrist, first fixation means (7, 5) mounted to said first protective element for fixation of said first protective element against the hand of the skater, said first protective element (2, 4) having an abutment section adapted for abutting against ground, a second protective element (3) adapted to be arranged on the inside portion of at least one of the wrist and the forearm of the skater, second fixation means (12) mounted to said second protective element for fixation of said second protective element against at least one of the wrist and the forearm, and a connecting element for articulated connection of said first protective element with said second protective element adapted for allowing the hand to rotate in a plane of the hand relative to the wrist and forearm.

100. The protective aid according to claim 99, characterized in that said connecting element is adapted to be arranged in the region of the distal end of the radius bone and of the os naviculare bone of the skater.

101. A protective aid according to claim 99, characterized in that said first protective element comprises a first protective plate (2) and said second protective element comprises a second protective plate (3).

102. A protective aid according to claim 99, characterized in that said first fixation means comprise at a side region of the first protective element a ring-like portion (5) for receiving a hand thumb in a ring hole and having self-centering properties.

103. A protective aid according to claim 99, characterized in that said first fixation means comprise a first band (7) having an adjustable length, with removable locking means (8, 9, 10), coupled to said first protective element and adapted to be arranged on a back of the hand.

104. A protective aid according to claim 99, characterized in that said second fixation means comprise a second band (12) of adjustable length, with removable locking means (13, 14), coupled to said second protective element (3) and adapted to be arranged on the outer side of the user's wrist.

105. A protective aid according to claim 99, characterized in that said first protective element (2) is provided, on a surface thereof opposite to said hand, with a contoured reinforcement element (4).

106. A protective aid according to claim 99, characterized in that said first protective element (2, 4) has a first contact surface for contact with the hand palm near the wrist and said second protective element (3) has a second contact surface for contact with the inside portion of the wrist.

107. A protective aid according to claim 106, characterized in that said first protective element comprises a shell-like carrier member (2) carrying said first contact surface.

108. A protective aid according to claim 106, characterized in that said second protective element comprises a shell-like carrier member (3) carrying said second contact surface.

109. A protective aid according to claim 106, characterized in that at least one of said contact surfaces is anatomically contoured in accordance with the anatomical contour of the hand palm near the wrist or the inside portion of the wrist, respectively.

110. A protective aid according to claim 99, characterized in that said first protective element (2, 4) comprises an abutment element (4) for abutting against ground in case of a fall of the skater and protecting at least that region of the hand palm near the wrist against direct contact with the ground.

111. A protective aid according to claim 110, characterized in that said abutment element (4) has shock-absorption properties.

112. A protective aid according to claim 111, characterized in that said abutment element (4) has a friction surface for frictional engagement with ground.

113. A protective aid according to claim 112, characterized in that said abutment element (4) is made from a material having a hardness providing a limited frictional engagement between said friction surface and ground so that in case of fall of the skater a gradual deceleration of the hand contacting ground via said abutment element is achieved with respect to a movement parallel to ground.

114. A protective aid according to claim 110, characterized in that said abutment element (4) is made from hard plastics.

115. A protective aid according to claim 110, characterized in that said abutment element (4) is made from hard plastics having a shore hardness (shore hardness D, DIN 53505) between 58 and 70.

116. A protective aid according to claim 110, characterized in that said abutment element (4) is made from hard plastics having a shore hardness (shore hardness D, DIN 53505) between 61 and 67.

117. A protective aid according to claim 110, characterized in that said first protective element (2, 4) comprises a shell-like carrier member (2) carrying said abutment element (4).

118. A protective aid according to claim 117, characterized by said connecting element (6) directly connecting said carrier member (2) and said second protective element (3).

119. A protective aid according to claim 118, characterized in that said connecting element comprises an articulation (6) articulating the second protective element (3) to the carrier member (2).

120. A protective aid according to claim 118, characterized in that said carrier member (2), at least in regions adjacent to the abutment element (4) and the connecting element (6), is made from hard plastics.

121. A protective aid according to claim 120, characterized in that said carrier member (2*b*) comprises a ring-like portion (5*b*) for receiving a hand thumb in a ring hole and at least partially being made from a softer material than the rest of the carrier member (2*b*).

122. A protective aid according to claim 121, characterized in that said softer material is soft plastics.

123. A protective aid according to claim 117, characterized by said connecting element (6*a*; 22*c*) directly connecting said abutment element (4*a*; 4*c*) and said second protective element (3*a*; 3*c*).

124. A protective aid according to claim 123, characterized in that said connecting element comprises an articulation (6*a*) articulating the second protective element (3*a*) to the abutment element (4*a*).

125. A protective aid according to claim 123, characterized in that said connecting element is formed by a web portion (22*c*) integrally connecting said abutment element (4*c*) and said second protective element (3*c*).

126. A protective aid according to claim 125, characterized in that said web portion (22*c*), said abutment element (4*c*) and a shell-like shield member (3*c*) of said second protective element are sections of a one-part piece of said protective aid (1*c*).

127. A protective aid according to claim 123, characterized in that said carrier member (2*a*; 2*c*) comprises a ring-like portion (5*a*; 5*c*) for receiving a hand thumb in a ring hole and in that said carrier member, at least in the region of said ring-like portion, is made from a softer material than the abutment element (4*a*; 4*c*).

128. A protective aid according to claim 127, characterized in that said softer material is soft plastics.

129. A protective aid according to claim 99, characterized in that said protective element comprises a shell-like shield member (3).

130. A protective aid according to claim 129, characterized in that said shield member is made from hard plastics.

131. A protective aid according to claim 99, characterized by said connecting element (6; 6*a*; 22*c*) and the other components of the protective aid (1; 1*a*; 1*b*; 1*c*) being arranged such with respect to the anatomy of the skater wearing the protective aid that the connecting element is located in the region of the distal end of the radius bone and of the "os naviculare" bone of the skater.

132. A protective aid according to claim 131, characterized in that said connecting element comprises an articulation (6, 6*a*) allowing a pivot movement of the first protective element (2, 4; 2*a*, 4*a*; 2*b*, 4*b*) with respect to the second protective element (3; 3*a*; 3*b*) about a pivot axis approximately orthogonal with respect to the inside portion of the wrist.

133. A protective aid according to claim 131, characterized by at least one of said connecting element (6; 6*a*; 22*c*) having such a stiffness and said connecting element (6; 6*a*; 22*c*) being to such an extent tension-proof and adapted to transmit tension forces between the hand and at least one of the forearm and the wrist via said first and second protective elements (2, 4, 3; 2*a*, 4*a*, 3*a*; 2*b*, 4*b*, 3*b*; 2*c*, 4*c*, 3*c*) and said first and second fixation means (5, 7, 12; 5*a*, 7*a*, 12*a*; 5*b*, 7*b*, 12*b*; 5*c*, 7*c*, 12*c*) engaging the hand and at least one of wrist and forearm, that an extension movement of the hand with respect to the forearm, namely a pivot movement of the hand with respect to the forearm during which the back of the hand approaches the outer side of the forearm is retarded by the protective aid (1; 1*a*; 1*b*; 1*c*) to protect against injuries in case of falls of the skater.

134. A protective aid according to claim 99, characterized in that said connecting element (6; 6*a*; 22*c*) and the other components of the protective aid (1; 1*a*; 1*b*; 1*c*) are arranged such with respect to the anatomy of the skater wearing the protective aid that the connecting element is located in the region of the distal end of the radius bone and of the "os naviculare" bone of the skater, said connecting element (6; 6*a*; 22*c*) having such properties with respect to (a) stiffness and (b) tensile strength and being adapted to transmit tension forces between the hand and at least one of the forearm and the wrist via said first and second protective elements (2, 4, 3; 2*a*, 4*a*; 3*a*; 2*b*, 4*b*, 3*b*; 2*c*, 4*c*, 3*c*) and said first and second fixation means (5, 7, 12; 5*a*, 7*a*, 12*a*; 5*b*, 7*b*, 12*b*; 5*c*, 7*c*, 12*c*) engaging the hand and at least one of wrist and forearm, that an extension movement of the hand with respect to the forearm, namely a pivot movement of the hand with respect to the forearm during which the back of the hand approaches the outer side of the forearm is possible to allow physiologically correct extension movements of the hand with respect to the forearm at least within a certain angle range and that at least excessive extension movements are slowed down by the protective aid (1; 1*a*; 1*b*; 1*c*) to protect against injuries in case of falls of the skater.

135. A protective aid (1) for protecting a hand and a wrist of a skater, said protective aid comprising:

a first protective element (2, 4) adapted to be arranged on that region of the hand near the wrist and provided with first fixation means (7) for fixation of said first protective element against the hand of the skater, said first protective element (2, 4) comprising an abutment section adapted for abutting against ground and a ring-like portion (5*a*; 5*b*) for receiving a hand thumb of the skater in a ring hole, said ring-like portion at least partially is made from a softer material than said abutment section, a second protective element (3) adapted to be arranged on the inside portion of at least one of the wrist and the forearm of the skater and provided with second fixation means (12) adapted for fixation of said second protective element against at least one of the wrist and the forearm, a connecting element connecting said first protective element (2, 4) and said second protective element.

136. The protective aid according to claim 135, characterized in that said ring-like portion (5*a*) and a carrier section (2*a*) of said first protective element carrying said abutment section (4*a*) is made from soft plastics and said abutment section is made from hard plastics.

137. A protective aid according to claim 135, characterized in said ring-like portion is at least partially made from a softer material than a shell-like protective section of said first protective element, said protective section having said abutment section.

138. A protective aid according to claim 137, characterized in that said ring-like portion is made from soft plastics and said protective section is made from hard plastics.

139. A protective aid according to claim 137, characterized in that said ring-like portion (5*b*) is formed as a band to be arranged around the thumb and being riveted at its two ends to the protective section (2*b*).

140. A protective aid according to claim 135, characterized in that said first protective element comprises a first protective plate (2) and said second protective element comprises a second protective plate (3).

141. A protective aid according to claim 135, characterized in that said first fixation means comprise a first band (7) having an adjustable length, with removable locking means (8, 9, 10), coupled to said first protective element and adapted to be arranged on a back of the hand.

142. A protective aid according to claim 135, characterized in that said second fixation means comprise a second band (12) of adjustable length, with removable locking means (13, 14), coupled to said second protective element (3) and adapted to be arranged on the outer side of the user's wrist.

143. A protective aid according to claim 135, characterized in that said first protective element (2) is provided, on a surface thereof opposite to said hand, with a contoured reinforcement element (4).

144. A protective aid according to claim 135, characterized in that said first protective element (2, 4) has a first contact surface for contact with the hand palm near the wrist and said second protective element (3) has a second contact surface for contact with the inside portion of the wrist.

145. A protective aid according to claim 144, characterized in that said first protective element comprises a shell-like carrier member (2) carrying said first contact surface.

146. A protective aid according to claim 144, characterized in that said second protective element comprises a shell-like carrier member (3) carrying said second contact surface.

147. A protective aid according to claim 144, characterized in that at least one of said contact surfaces is anatomically contoured in accordance with the anatomical contour of the hand palm near the wrist or the inside portion of the wrist, respectively.

148. A protective aid according to claim 135, characterized in that said first protective element (2, 4) comprises an abutment element (4) for abutting against ground in case of a fall of the skater and protecting at least that region of the hand palm near the wrist against direct contact with the ground.

149. A protective aid according to claim 148, characterized in that said abutment element (4) has shock-absorption properties.

150. A protective aid according to claim 149, characterized in that said abutment element (4) has a friction surface for frictional engagement with ground.

151. A protective aid according to claim 150, characterized in that said abutment element (4) is made from a material having a hardness providing a limited frictional engagement between said friction surface and ground so that in case of fall of the skater a gradual deceleration of the hand contacting ground via said abutment element is achieved with respect to a movement parallel to ground.

152. A protective aid according to claim 148, characterized in that said abutment element (4) is made from hard plastics.

153. A protective aid according to claim 148, characterized in that said abutment element (4) is made from hard plastics having a shore hardness (shore hardness D, DIN 53505) between 58 and 70.

154. A protective aid according to claim 148, characterized in that said abutment element (4) is made from hard plastics having a shore hardness (shore hardness D, DIN 53505) between 61 and 67.

155. A protective aid according to claim 148, characterized in that said first protective element (2, 4) comprises a shell-like carrier member (2) carrying said abutment element (4).

156. A protective aid according to claim 155, characterized in that said connecting element (6) directly connecting said carrier member (2) and said second protective element (3).

157. A protective aid according to claim 156, characterized in that said connecting element comprises an articulation (6) articulating the second protective element (3) to the carrier member (2).

158. A protective aid according to claim 156, characterized in that said carrier member (2), at least in regions adjacent to the abutment element (4) and the connecting element (6), is made from hard plastics.

159. A protective aid according to claim 158, characterized in that said carrier member (2*b*) comprises a ring-like portion (5*b*) for receiving a hand thumb in a ring hole and at least partially being made from a softer material than the rest of the carrier member (2*b*).

160. A protective aid according to claim 159, characterized in that said softer material is soft plastics.

161. A protective aid according to claim 155, characterized by said connecting element (6*a*; 22*c*) directly connecting said abutment element (4*a*; 4*c*) and said second protective element (3*a*; 3*c*).

162. A protective aid according to claim 161, characterized in that said connecting element comprises an articulation (6*a*) articulating the second protective element (3*a*) to the abutment element (4*a*).

163. A protective aid according to claim 161, characterized in that said connecting element is formed by a web portion (22*c*) integrally connecting said abutment element (4*c*) and said second protective element (3*c*).

164. A protective aid according to claim 163, characterized in that said web portion (22*c*), said abutment element (4*c*) and a shell-like shield member (3*c*) of said second protective element are sections of a one-part piece of said protective aid (1*c*).

165. A protective aid according to claim 161, characterized in that said carrier member (2*a*; 2*c*) comprises a ring-like portion (5*a*; 5*c*) for receiving a hand thumb in a ring hole and in that said carrier member, at least in the region of said ring-like portion, is made from a softer material than the abutment element (4*a*; 4*c*).

166. A protective aid according to claim 165, characterized in that said softer material is soft plastics.

167. A protective aid according to claim 135, characterized in that said second protective element comprises a shell-like shield member (3).

168. A protective aid according to claim 167, characterized in that said shield member is made from hard plastics.

169. A protective aid according to claim 135, characterized by said connecting element (6; 6*a*; 22*c*) and the other components of the protective aid (1; 1*a*; 1*b*; 1*c*) being arranged such with respect to the anatomy of the skater wearing the protective aid that the connecting element is located in the region of the distal end of the radius bone and of the "os naviculare" bone of the skater.

170. A protective aid according to claim 169, characterized in that said connecting element comprises an articulation (6; 6*a*) allowing a pivot movement of the first protective element (2, 4; 2*a*, 4*a*; 2*b*; 4*b*) with respect to the second protective element (3; 3*a*; 3*b*) about a pivot axis approximately orthogonal with respect to the inside portion of the wrist.

171. A protective aid according to claim 169, characterized by at least one of said connecting element (6; 6*a*; 22*c*) having such stiffness and said connecting element (6; 6*a*; 22*c*) being to such an extent tension-proof and adapted to transmit tension forces between the hand and at least one of the forearm and the wrist via said first and second protective elements (2, 4, 3; 2*a*, 4*a*, 3*a*; 2*b*, 4*b*, 3*b*; 2*c*, 4*c*, 3*c*) and said first and second fixation means (5, 7, 12; 5*a*, 7*a*, 12*a*; 5*b*, 7*b*, 12*b*; 5*c*, 7*c*, 12*c*) engaging the hand and at least one of wrist and forearm, that an extension movement of the hand with respect to the forearm, namely a pivot movement of the hand with respect to the forearm during which the back of the hand approaches the outer side of the forearm is retarded by the protective aid (1; 1*a*; 1*b*; 1*c*) to protect against injuries in case of falls of the skater.

* * * * *